US008205289B1

(12) United States Patent
Croft

(10) Patent No.: US 8,205,289 B1
(45) Date of Patent: Jun. 26, 2012

(54) HAND TOOL

(76) Inventor: Jeff L. Croft, Barberton, OH (US)

( * ) Notice: Subject to any disclaimer, the term of this patent is extended or adjusted under 35 U.S.C. 154(b) by 1535 days.

(21) Appl. No.: 10/958,752

(22) Filed: Oct. 5, 2004

(51) Int. Cl.
*B28B 17/00* (2006.01)
*A47L 1/06* (2006.01)

(52) U.S. Cl. ..... 15/245.1; 15/235.4; 15/236.07

(58) Field of Classification Search ..... 15/245.1, 15/235.4, 235.5, 236.01, 236.07; 425/458
See application file for complete search history.

(56) References Cited

U.S. PATENT DOCUMENTS

| | | | | |
|---|---|---|---|---|
| 952,971 | A | 3/1910 | Wolary et al. | |
| 1,067,301 | A | 7/1913 | Bricker | |
| 1,083,099 | A | 12/1913 | Howg | |
| 2,301,498 | A | 11/1942 | Ames | 72/136 |
| 2,725,740 | A | 12/1955 | Borgstrom | 72/136 |
| 2,934,936 | A | 5/1960 | Vernon | 72/136 |
| 2,944,275 | A * | 7/1960 | Markusen | 15/236.01 |
| 2,947,017 | A | 8/1960 | Dybdahl | 15/235.8 |
| 4,097,951 | A | 7/1978 | Hurtt | 15/104 |
| 4,129,407 | A | 12/1978 | Golls et al. | 425/87 |
| 4,516,868 | A | 5/1985 | Molnar | 401/5 |
| 4,654,919 | A | 4/1987 | Liberman | 15/104 S |
| 5,122,006 | A | 6/1992 | MacMillan | 401/5 |
| 5,192,558 | A | 3/1993 | Sparrow et al. | 425/87 |
| 5,351,357 | A | 10/1994 | Liberman | 15/245.1 |
| 5,611,102 | A | 3/1997 | Lesinsky et al. | 15/235.5 |
| 5,664,280 | A | 9/1997 | Tonsager | 15/235.7 |
| 5,759,590 | A | 6/1998 | Cacossa | 425/183 |
| 6,032,320 | A | 3/2000 | McComber et al. | 15/235.4 |
| 6,044,516 | A | 4/2000 | Lev | 15/235.4 |
| 6,415,472 | B1 * | 7/2002 | Williams | 15/235.4 |
| 6,595,764 | B1 | 7/2003 | Volk | 425/87 |
| 7,048,618 | B1 * | 5/2006 | Cramer | 451/59 |
| 2002/0002754 | A1 | 1/2002 | Wendel | 15/245.1 |

* cited by examiner

*Primary Examiner* — Shay Karls
(74) *Attorney, Agent, or Firm* — Shannon V. McCue; Hahn Loeser & Parks LLP

(57) ABSTRACT

A hand tool (10) for shaping joint compound (64) applied to a wall including a substantially rigid blade (12) having a handle (14), and wherein the blade (12) has a preselected non-adjustable curvature (12).

7 Claims, 4 Drawing Sheets

HAND TOOL

RELATED PATENT APPLICATIONS

None.

TECHNICAL FIELD

The present invention generally relates to a hand tool used to apply joint compound to various surfaces including drywall butt joints. More particularly, the present invention relates to a hand tool having a substantially rigid blade held at a preselected curvature for applying joint compound in a consistent and repeatable manner.

BACKGROUND ART

Drywall is the preferred material used in construction of most interior building walls. A typical construction method includes first creating a frame, then fastening sheets of drywall to the frame. In fastening the drywall to the frame, adjacent drywall sheets form a number of joints including corner joints, which may be overlapped or mortared, and butt joints where the ends of adjacent sheets abut each other.

When attempting to tape and finish drywall, one of the most difficult tasks involves finishing the joints so that they are no longer visible. Often times, professionals rely on automatic finishing "boxes" to achieve both the speed and precision necessary for commercial jobs. These tools typically comprise a box which holds a volume of joint compound, and an adjustable blade which defines an opening. The compound exits the box through the opening and is applied to the joint, with the profile of the joint compound being defined by the blade. Due to the fact that the shape of the blade remains constant during use, the user achieves a perfect joint profile or shape, and the joint compound is applied in a consistent and repeatable manner.

Unfortunately, these tools prove to be too cumbersome, complicated and too expensive for the "do-it-yourselfer". They also require a lot of strength to use, as sufficient force is required to both hold up the volume of joint compound and position it on the wall. Consequently, most home improvement drywall projects are accomplished using hand tools, such as taping knives, trowels and the like.

Hand tools currently available lack the structural integrity required to maintain the proper blade shape during use. Achieving the proper profile is nearly impossible for the untrained hand. Butt joints and irregular joints are particularly the most challenging. Localized blade deflection is just one of the problems with these tools. Generally, existing drywall hand tools are comprised of a flat or curved thin metal blade attached to a handle, such as that shown in FIG. 1. The blade is flexible, such that, as pressure is applied during use, the blade is flattened against the drywall, as seen in FIG. 2. This results in application of an improper amount of joint compound, which in turn requires multiple applications and/or repeated sanding to remove the excess compound.

In terms of joint shape or profile, to provide the effect of a continuous surface, the shape of the applied material is used to mask the joints. Existing blades which are flexible across their entire surface, locally distort as pressure is applied to them creating irregular or improperly shaped compound at the joint. To correct this, the user may have to shape the compound by sanding the dried compound, apply more compound, or in the worst case, remove the existing compound and start over. The time and effort of correcting the imperfections created by existing drywall compound hand tools may overwhelm a "do-it-yourselfer".

Therefore, it is apparent that there is a need in the art for a drywall hand tool, which is easy to use and applies joint compound in a consistent and repeatable fashion.

SUMMARY OF THE INVENTION

It is an object of the present invention to provide an improved hand tool for applying joint compound and the like.

In general, the present invention provides a hand tool for shaping compound applied to a wall including a substantially rigid blade having a handle, wherein the blade has a preselected non-adjustable curvature.

The present invention further provides a hand tool for shaping joint compound applied to a wall including a handle, a substantially rigid blade mounted on the handle, which has a preselected non-adjustable curvature and a reinforcing member. The blade includes a front edge, adapted to contact a wall and a pair of side edges extending rearward from the front edge toward the handle, and wherein the reinforcing member is coupled to the blade and extends substantially from one of the side edges to the other side edge.

BRIEF DESCRIPTION OF THE DRAWINGS

A hand tool according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 3:
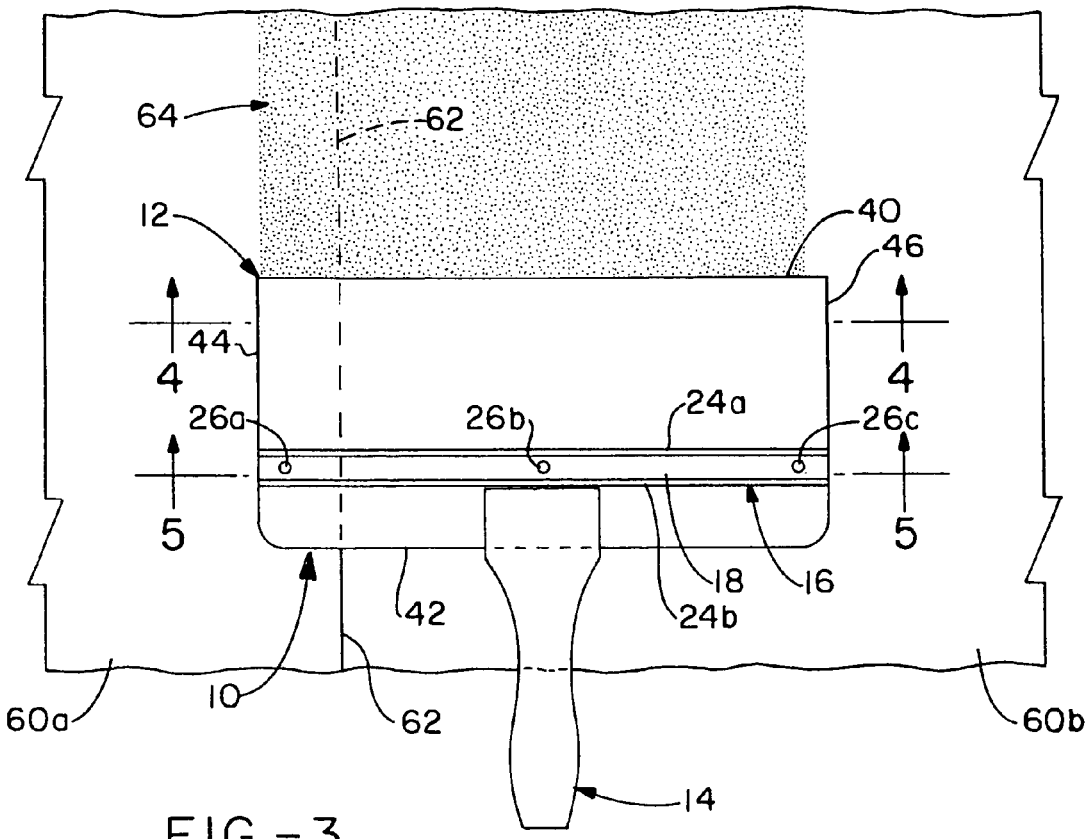
FIG. 3. is a top view of a drywall hand tool in accordance with the present invention.

A drywall hand tool made in accordance with the present invention is indicated generally by the numeral 10. Referring now to FIG. 3, drywall hand tool 10 includes a blade 12 that is substantially rigid and has a preselected curvature. The curvature is created by the manufacturer and remains substantially constant throughout the life of the tool. The curvature is maintained because the blade is substantially rigid and because the hand tool 10 may include a reinforcing member 16, adapted to help maintain the preselected curvature of the blade. Hand tool 10 may further include a handle 14, which is adapted to facilitate gripping during use and may be made of wood, plastic, or any other suitable material. Handle 14 is generally anything that facilitates gripping of the hand tool 10, and may be integrally formed with the blade 12, for example, raised or recessed surfaces, or hand holds are attached to the blade, for example, flexible hand holds, such as the handle 14 depicted in the drawings. Handle 14 may be oriented in generally any direction. In the example shown, handle 14 extends rearwardly of blade 12. Another suitable configuration would include the handle oriented over the blade in a trowel-type configuration.

Figure 1:
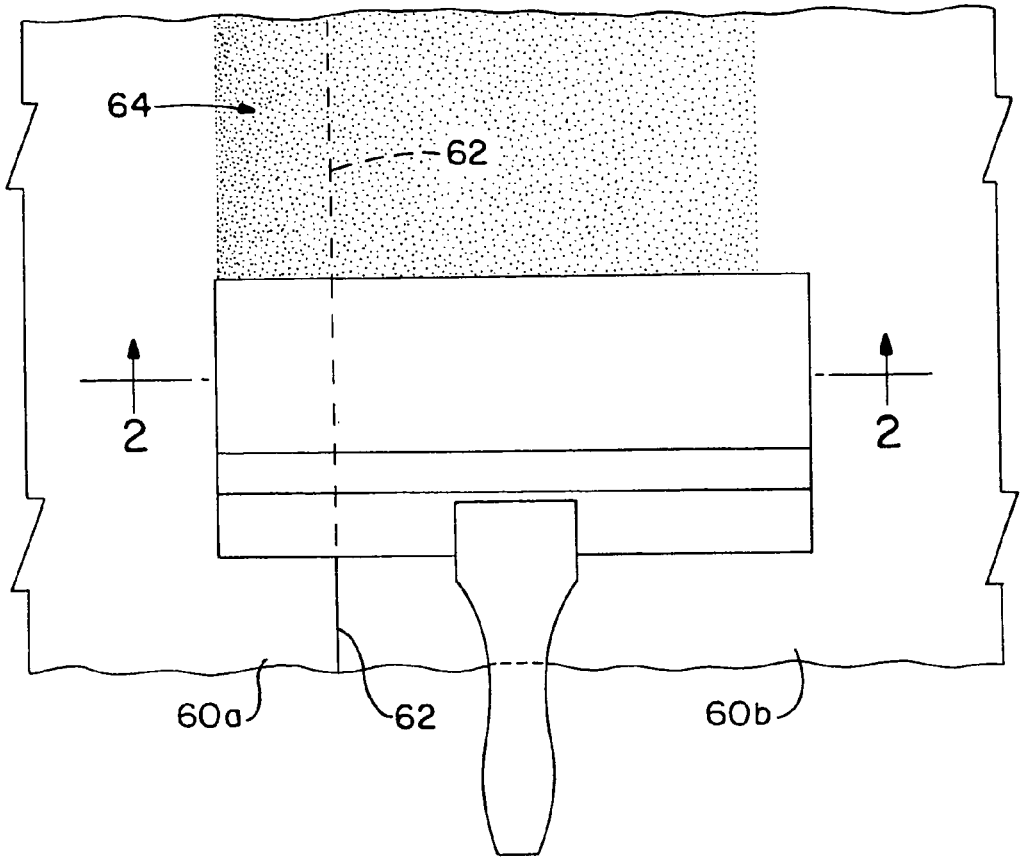
FIG.-1 PRIOR ART
FIG. 1 is a top view of a prior art drywall hand tool as it may be used to cover or seal a joint between two abutting drywall panels.
Figure 2:
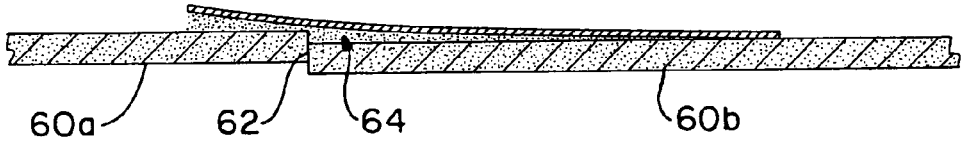
FIG.-2 PRIOR ART
FIG. 2 is a cross-sectional view of the prior art hand tool shown in FIG. 1, as may be taken at 2-2.

As earlier mentioned, hand tool 10 may include a reinforcing member 16. Generally, reinforcing member 16 may help hold the blade 12 in a curved orientation, although it is not required. Alternatively, the reinforcing member may be used to impart the selected curvature to the blade 12. The blade 12 is constructed with sufficient strength to prevent a user from distorting the blade from the desired shape, to that extent, the blade 12 is considered substantially rigid and is not subject to local deflections prevalent in existing blades (FIG. 2).

Figure 5:
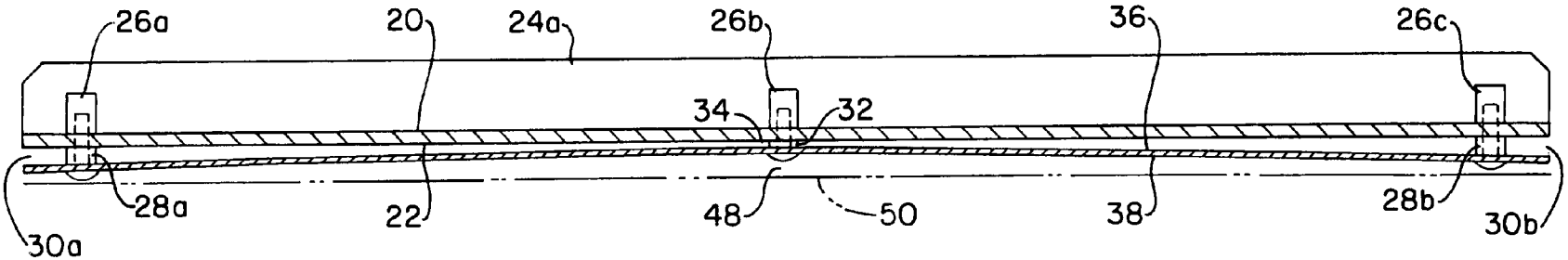
FIG. 5. is a full scale cross-sectional view as may be taken at line 5-5 in FIG. 3 illustrating the hand tool, wherein the contour is exaggerated for the purpose of the description only and not to be a limiting factor in the invention.

The handle 14 or reinforcing member 16 may be adapted to impart the selected curvature to an otherwise flat blade, as described more completely below. Handle 14 may be coupled to the blade 12 or the reinforcing member 16. The reinforcing member 16 may be rigid, to that end, steel or aluminum may be used. The material must be thick enough to resist bending under typical use conditions. By profiling reinforcing member 16 to have an increased moment of inertia, greater resistance to the bending moments may be achieved with less material. For example, as best shown in FIGS. 3 and 5, portions of the reinforcing member may project away from the blade in order to better resist the bending moments. In the embodiment shown, reinforcing member 16 includes a base 18 having a first surface 20 facing away from blade 12 and a second surface 22 facing towards blade 12. A pair of ribs 24*a* and 24*b* are located on opposed ends of base 18 and extend away from first surface 20. Ribs 24*a* and 24*b* help resist any residual bending forces blade 12 may exert, while also resisting forces applied to hand tool 10 by the user during use. It should be appreciated that various other designs of reinforcing member 16 may be used including designs wherein no ribs are present.

Referring now to FIG. 5, reinforcing member 16 may be coupled to the blade 12 by fasteners 26. The present embodiment employs three fasteners 26*a*, 26*b*, 26*c*, although it should be appreciated that more or less than three may be used. Two fasteners 26*a*, 26*c* are located near the ends of reinforcing member 16 and one fastener 26*b* is located in the middle. In the present embodiment, the fasteners 26 comprise snap rivets, although it should be appreciated that any fastener including suitable welds or adhesives may be used.

As shown, reinforcing member 16 may include a pair of spacers 28*a* and 28*b*, positioned between the blade 12 and base 18 about the shaft of the two end fasteners 26*a* and 26*c*. In this way, the spacers 28*a*, 28*b* provide sufficient leverage to import the necessary curvature to the blade 12. By incorporating spacers 28*a* and 28*b* between the blade 12 and reinforcing member 16, gaps 30*a* and 30*b* are defined. The hand tool may include a center spacer 32, which is located between the blade 12 and reinforcing member 16 on the shaft of fastener 26*b*. It should be appreciated that although a central spacer is included in the depicted embodiment, one is not required. Center spacer 32 creates a center gap 34 between blade 12 and reinforcing member 16. The gap 34 is in all cases smaller that gaps 30*a* and 30*b* and if no center spacer 32 is present, reinforcing member 16 is flush with the blade 12 in the center. Because of the divergence in gap heights between the blade 12 and reinforcing member 16, the blade 12 is held in a curved orientation.

The blade 12 includes a first surface 36 facing the reinforcing member 16 and a second surface 38 facing away from reinforcing member 16. The second surface 38 contacts joint compound 64 during use. The blade 12 is curved, such that the blade's first surface 36 is convex and blade second surface 38 is concave. The concavity of the blade is fixed at the time of manufacture and may not be adjustable. If a reinforcing member 16 is included, spacers 28*a* and 28*b* help to hold blade 12 relatively further away from reinforcing member 16 than the center spacer 32 (if one is present), further stiffening the blade. It should be appreciated that the curvature of the blade is exaggerated in FIGS. 5 and 6 and typical blade radius (R) is very slight, for example, approximately 100-300 inches. The blade 12 further includes a front edge 40 located opposite a rear edge 42. It is important to note that while the blade 12 is substantially rigid, even stiff metals, such as aluminum or steel will deflect minimally. Because of the stiffness of the blade and further through the incorporation of the optional reinforcing member, localized deflection does not occur, under pressure, while the blade 12 may deflect to a small extent, the blade 12 maintains the desired profile. This feature helps achieve the desired uniform joint compound profile.

The curvature of the blade 12 may be substantially uniform from the front edge 40 to the back edge 42. In other words, the radius R measured at the front edge 40 is substantially similar to the radius R at the back edge 42. While using the hand tool 10 on a flat surface, the curvature creates a channel 48 between the second surface 38 and the drywall which the blade 12 is held against. The channel is defined by the blade 12 and a plane 50 which runs from the edge 44 to edge 46. Because of the stiffness of the blade 12 and optionally, the inclusion of the reinforcing member 16, the radius R, and, thus, the channel shape, stays substantially the same, even as additional force is applied to the blade 12 via the handle 14.

If a reinforcing member 16 is included, it's long axis may be oriented, such that it is parallel with edges 40 and 42 and extends substantially from side edge 44 to side edge 46. The reinforcing member may be offset i.e., mounted closer to the rear edge 42 than the front edge 40. This orientation gives greater control to the user, while still enabling the reinforcing member to provide the necessary curvature support to the blade 12.

It should further be appreciated that if a reinforcing member 16 is included, blade curvature may be created in two ways. First, the blade 12 may be preformed in the desired curved orientation. In this case the reinforcing member merely adds to the rigidity of the blade 12. Or blade curvature may be created by the reinforcing member itself. In this instance, the blade curvature is not preformed before mounting and the act of mounting the blade to the reinforcing member forces the blade into the curved orientation, as described above.

Figure 4:
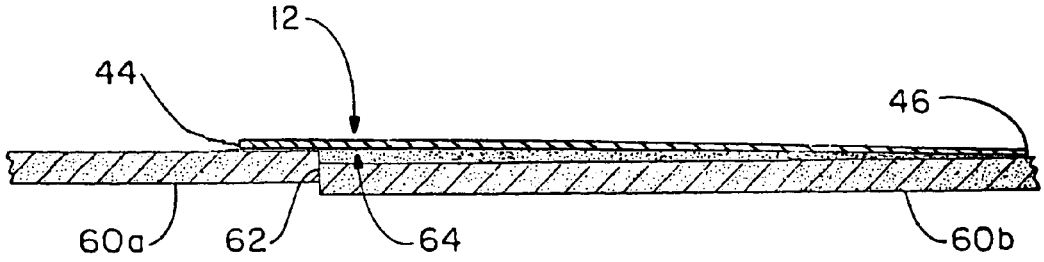
FIG. 4. is a cross-sectional view of the drywall hand tool shown in FIG. 3.

One use for hand tool 10 may include shaping joint compound in butt joints. Referring particularly to FIG. 4, two pieces of drywall 60*a* and 60*b* abut each other as would be the case when installing drywall in a home or business. The area of contact is called a butt joint 62.

When using the hand tool 10, the user first applies an appropriate amount of joint compound 64 to the joint 62, using a spatula, puddy knife or other suitable tool. The user then places the tool edge 40 on the drywall. The blade 12 is generally positioned, such that the offset between sheets 60*a* and 60*b* is filled.

In the example shown in FIGS. 3 and 4, the blade 12 is set so that the joint 62 resides near one side 44 of the blade with little or no coverage of the raised sheet 60*a*. In this way the thickest portion of the channel 48 lies over the recessed sheet 60*b* allowing the compound 64 to fill the offset between the sheets 60*a*, 60*b*. The curvature of the blade 12 causes the channel thickness to gradually taper off toward side edges 44 evening out the joint 62. The curvature of the blade 12 provides a curved bead of compound 64 that creates a less obtrusive transition between sheets 60*a*, 60*b*. The user may orient the blade 12, such that an angle is formed between the blade 12 and drywall, for example, a suitable angle may be approximately 10-25 degrees.

Figure 7:
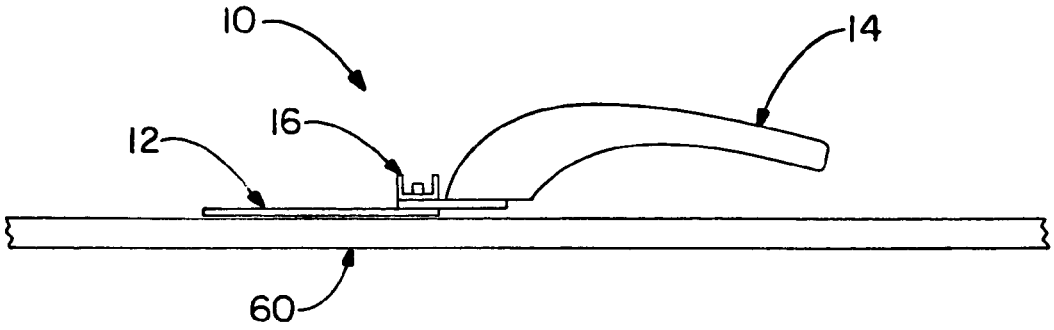
FIG. 7 is a side elevational view illustrating a configuration for an off-set handle on the hand tool of the invention.

As shown in FIG. 7, the handle 14 may be offset relative to the blade 12 away from the wall. The offset provides a clearance for the user's fingers and also may improve the user's leverage in applying compound 64 to the wall. The user then applies force to the hand tool 10 in the direction of the wall and slides the hand tool 10 along the length of the joint, all the while maintaining substantially constant force. Joint compound 64 flows through the channel 48 created between the blade 12 and drywall sheets 60. Because the blade 12 is substantially rigid, the applied pressure forces joint compound into the joint while achieving a substantially constant curved shape. The user then wipes away any remaining joint compound outside the blade contact area and the resulting coating of joint compound is of optimal shape.

Figure 6:
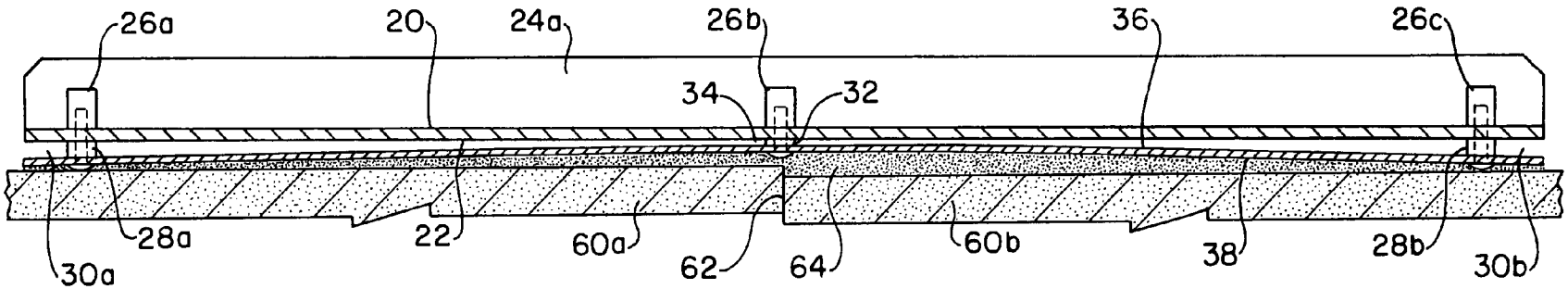
FIG. 6 is a cross-sectional view similar to FIG. 5 but illustrating how the present invention overcomes the problem with prior art drywall hand tools when attempting to cover and/or seal an uneven joint between two abutting drywall panels.

This design is preferable over prior art hand tools, as is evident from a comparison between the prior art hand tool of FIG. 2 and the present invention in FIG. 6. Referring now to FIG. 2, relatively flexible prior art hand tools flatten or deform locally as the user applies force. Therefore, users do not achieve an optimal curved bead of joint compound. Instead, the user is left with the arduous task of sanding and reapplying compound. While using the present invention, as seen in FIG. 6, the user need only draw the hand tool against the compound to achieve a selected joint profile. The manufacturer sets the selected curvature, thereby taking the guess work out of the process for the end user.

In light of the foregoing, it should thus be evident that a drywall hand tool constructed as described herein substantially improves the art.

What is claimed is:

1. A hand tool for shaping joint compound applied to a wall comprising:

a rigid blade having a handle;

wherein said blade has a preselected non-adjustable curvature; and a reinforcing member, said reinforcing member having a long axis, said long axis being oriented parallel to a front edge of said blade, wherein said reinforcing member extends substantially from one side edge of said blade to the other side edge of said blade, wherein said blade is mounted to said reinforcing member, and wherein said curvatures created by a pair of spacers mounted between said blade and said reinforcing member.

2. the hand tool of claim 1, wherein said curvature is substantially constant from a front edge of the blade to a back edge of the blade.

3. The hand tool of claim 1, wherein said reinforcing member comprises a base and a pair of ribs extending outward therefrom relative to said blade.

4. The hand tool of claim 1, wherein the blade curvature has a substantially constant radius from one side edge of the blade to the other side edge of the blade.

5. A hand tool for shaping joint compound applied to a wall comprising:

a rigid blade which has a preselected non-adjustable curvature;

a reinforcing member; and wherein said blade includes a front edge, adapted to contact the wall and a pair of side edges perpendicular to said front edge, and wherein said reinforcing member is coupled to said blade and extends substantially from one of said side edges to the other said side edge, wherein said blade is mounted to reinforcing member by a plurality of fasteners, and wherein said curvature is created by a pair of spacers mounted between said blade and said reinforcing member about the two outer most fasteners.

6. The hand tool of claim 5, wherein said curvature is substantially constant from said front edge of the blade to a back edge of said blade.

7. The hand tool of claim 5, wherein said reinforcing member comprises a base and a pair of ribs extending laterally therefrom.

* * * * *